US007698911B2

(12) United States Patent
Mills et al.

(10) Patent No.: US 7,698,911 B2
(45) **Date of Patent: *Apr. 20, 2010**

(54) METHODS AND SYSTEMS FOR DETECTING DRYNESS OF CLOTHES IN AN APPLIANCE

(75) Inventors: Robert T. Mills, Louisville, KY (US); Timothy D. Worthington, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 1173 days.

This patent is subject to a terminal disclaimer.

(21) Appl. No.: 11/290,752

(22) Filed: Nov. 30, 2005

(65) Prior Publication Data

US 2007/0118996 A1 May 31, 2007

(51) Int. Cl.
*D06F 33/00* (2006.01)

(52) U.S. Cl. ..... 68/12.02; 68/12.01; 68/12.13; 68/12.15; 68/12.23

(58) Field of Classification Search ..... 68/12.01, 68/12.02, 12.13, 12.23
See application file for complete search history.

(56) References Cited

U.S. PATENT DOCUMENTS

| | | | | |
|---|---|---|---|---|
| 3,942,265 | A | 3/1976 | Sisler et al. | |
| 3,978,694 | A * | 9/1976 | Hughes et al. | 68/18 R |
| 4,397,101 | A | 8/1983 | Rickard | |
| 4,483,152 | A * | 11/1984 | Bitondo | 62/175 |
| 4,513,590 | A * | 4/1985 | Fine | 68/18 C |
| 4,603,489 | A * | 8/1986 | Goldberg | 34/77 |
| 4,763,425 | A | 8/1988 | Grennan | |
| 4,827,627 | A | 5/1989 | Cardoso | |
| 5,172,490 | A | 12/1992 | Tatsumi et al. | |
| 5,510,029 | A * | 4/1996 | Benian | 210/333.01 |
| 5,564,831 | A | 10/1996 | Bashark | |
| 6,757,988 | B2 | 7/2004 | Bruntz et al. | |
| 6,784,673 | B2 | 8/2004 | Tomasi et al. | |
| 7,469,486 | B2 * | 12/2008 | Tamura et al. | 34/77 |
| 2004/0261286 | A1 * | 12/2004 | Green et al. | 34/527 |
| 2005/0204583 | A1 * | 9/2005 | Kim | 34/604 |
| 2007/0039358 | A1 * | 2/2007 | Mills et al. | 68/18 F |

FOREIGN PATENT DOCUMENTS

WO WO 2005/031231 * 4/2005

* cited by examiner

*Primary Examiner*—Michael Barr
*Assistant Examiner*—Jason Heckert
(74) *Attorney, Agent, or Firm*—George L. Rideout, Esq.; Armstrong Teasdale LLP

(57) ABSTRACT

A control system for a clothes treating apparatus includes a first temperature sensor, a second temperature sensor, and a controller operatively coupled to the sensors. The apparatus includes a cabinet, a wash tub mounted within the cabinet and configured to receive clothes therein, a dehumidifying assembly, and a fan configured to draw air from the wash tub to the dehumidifying assembly and channel the air from the dehumidifying assembly back to the wash tub. The first temperature sensor is configured to detect a temperature of the air entering the dehumidifying assembly. The second sensor is configured to detect a temperature of the air exiting the dehumidifying assembly. The controller is configured to determine a dryness level of the clothes contained in the wash tub based on the detected air temperatures.

16 Claims, 5 Drawing Sheets

METHODS AND SYSTEMS FOR DETECTING DRYNESS OF CLOTHES IN AN APPLIANCE

BACKGROUND OF THE INVENTION

This invention relates generally to clothes treating apparatus, and, more particularly, to methods and systems for detecting dryness of clothes in an apparatus.

At least some known fabric care machines include a cabinet that houses an outer tub for containing a quantity of cleaning fluid, a perforated clothes basket within the tub, and a storage tank for storing the cleaning fluid. A drive and motor assembly is mounted underneath the stationary outer tub to rotate the basket within the tub. Generally, the cleaning machine performs a cleaning cycle followed by a spin cycle and a drying cycle.

In at least one cleaning cycle, the clothes are saturated with cleaning fluid and tumbled in an amount of cleaning fluid. The cleaning fluid dissolves certain fluid soluble soils. The clothes are tumbled to dislodge some insoluble soils and generally to increase the effectiveness of the cleaning process. Due to the cost of certain cleaning fluids, the fluid is not discarded, rather, the fluid, such as dry cleaning fluid, is filtered to remove particulates, such as lint, cleaned, and returned to the storage tank for reuse.

In a typical drying cycle, the cleaning fluid is drained from the tub and fluid remaining in the clothes after spinning is evaporated from the clothes to dry the clothes. At least some known fabric care machines perform the drying cycle for a predetermined time period for obtaining a desired dryness level of the clothes. However, the appropriate time period is varied based on the types of chemical that is used to wash or rinse the clothes, and a drying time period shorter or longer than the necessary time period may result in unsatisfied dryness result of the clothes or undesired energy wastage.

BRIEF DESCRIPTION OF THE INVENTION

In one aspect, a control system for a fabric care apparatus is provided. The apparatus includes a cabinet, a wash tub mounted within the cabinet and configured to receive clothes therein, a dehumidifying assembly, and a fan configured to draw air from the wash tub to the dehumidifying assembly and channel the air from the dehumidifying assembly back to the wash tub. The control system includes a first temperature sensor configured to detect a temperature of the air entering the dehumidifying assembly, a second temperature sensor configured to detect a temperature of the air exiting the dehumidifying assembly, and a controller operatively coupled to the sensors. The controller is configured to determine a dryness level of the clothes contained in the wash tub based on the detected air temperatures.

In another aspect, a fabric care apparatus is provided. The apparatus includes a cabinet, a wash tub mounted within the cabinet and configured to receive clothes therein, a dehumidifying assembly mounted within the cabinet and configured to remove vaporized fluid from the airflow therethrough, and a fan configured to draw air from the wash tub to the dehumidifying assembly and channel the air from the dehumidifying assembly back to the wash tub. The apparatus also includes at least one detecting component configured to detect an operational status of the dehumidifying assembly. The at least one detecting component including at least one of a temperature sensor, a pressure transducer, and a wattage metering component, and a controller operatively coupled to the detecting component. The controller is configured to receive a signal from the detecting component and determine a dryness level of the clothes received in the wash tub based on the received signal.

In still another aspect, a method for assembling a fabric care apparatus includes providing a cabinet and mounting a wash tub within the cabinet wherein the wash tub is configured to receive clothes therein. The method also includes mounting a dehumidifying assembly within the cabinet wherein the dehumidifying assembly is configured to remove vaporized fluid from the air flow therethrough, and providing a fan configured to draw air from the wash tub to the dehumidifying assembly and channel the air from the dehumidifying assembly back to the wash tub. The method further includes providing at least one detecting component configured to detect an operational status of the dehumidifying assembly. The at least one detecting component including at least one of a temperature sensor, a pressure transducer, and a wattage metering component. The method also includes operatively coupling a controller with the detecting component wherein the controller is configured to receive a signal from the detecting component and determine a dryness level of the clothes contained in the wash tub based on the received signal.

In still another aspect, a method for detecting dryness of clothes in a fabric care apparatus is provided. The apparatus includes a cabinet, a wash tub mounted within the cabinet for receiving clothes therein, a dehumidifying assembly, a fan for drawing air from the wash tub to the dehumidifying assembly and channeling the air from the dehumidifying assembly back to the wash tub, and at least one detecting component positioned within the cabinet. The dehumidifying assembly includes a compressor, a condenser, and an evaporator which allow refrigerant to flow therethrough. The method includes operating the at least one detecting component to detect an operational status of the dehumidifying assembly wherein the operational status includes at least one of a temperature value, a pressure value, and a wattage value. The method also includes estimating a dryness level of the clothes contained in the wash tub based on the detected operational status.

DETAILED DESCRIPTION OF THE INVENTION

Figure 1:
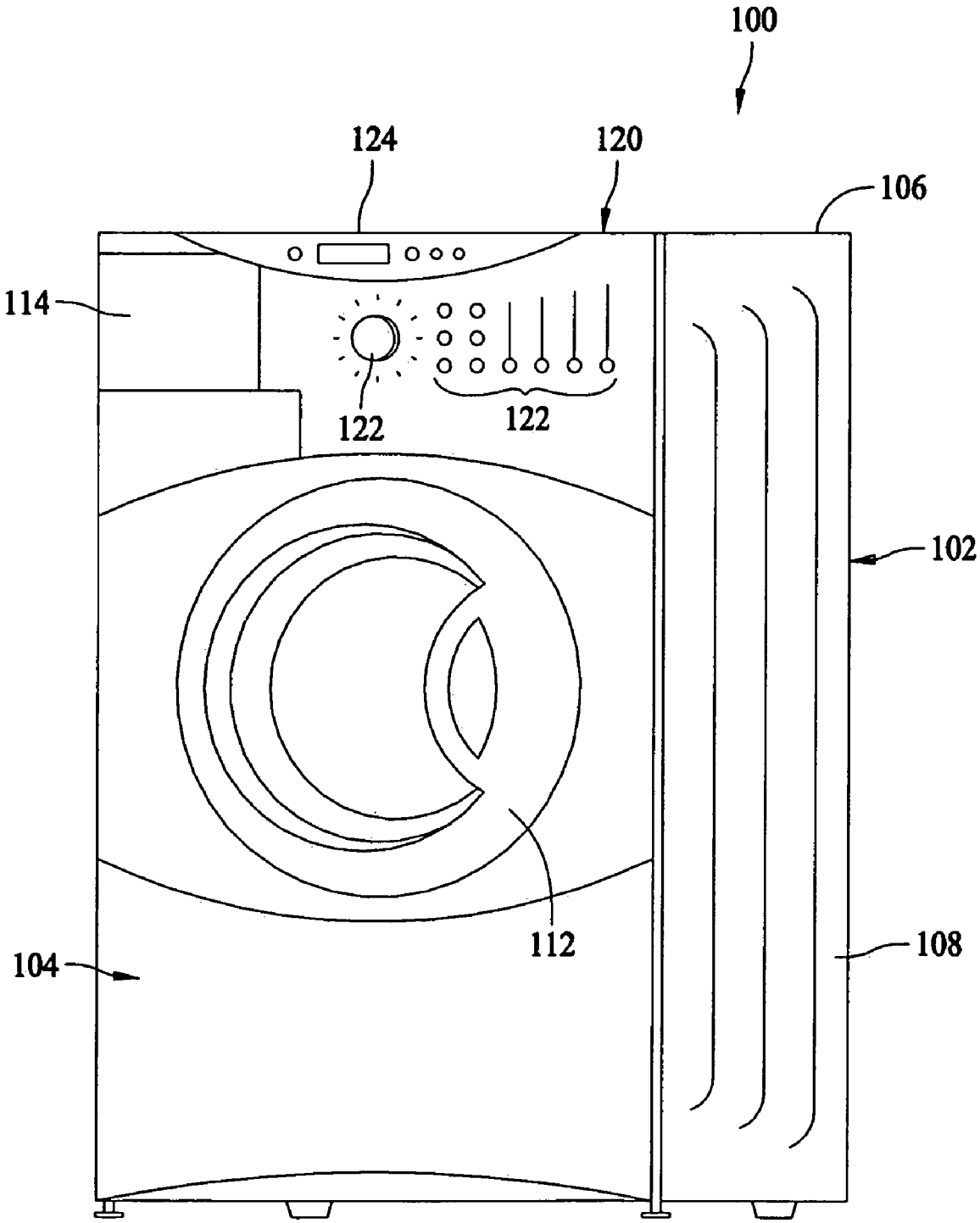
FIG. 1 is a perspective view of an exemplary fabric care machine.

FIG. 1 is a perspective view of an exemplary fabric care machine 100. Fabric care machine 100 includes a cabinet 102 having a front panel 104, a top panel 106, and side panels 108. A door 112 is mounted to front panel 104 and is rotatable about a hinge (not shown) between an open position (not shown) facilitating access to a basket (not shown) in the interior of machine 100 that holds a clothes load, and a closed position (as shown in FIG. 1) forming a substantially sealed enclosure over the basket. Front panel 104 also includes a cover 114 that covers a dual lint filter user interface (see FIG. 2). A control panel 120 including a plurality of input selectors 122 is coupled to an upper portion of front panel 104. Control panel 120 and input selectors 122 collectively form a user interface for operator selection of machine cycles and features, and, in one embodiment, a display section 124 indicates selected features, machine status, and other items of interest to users.

As illustrated in FIG. 1, machine 100 is a horizontal axis dry cleaning machine. It is contemplated that the benefits of the invention accrue to other types of dry cleaning machines, including, but not limited to, vertical axis machines. It is also contemplated that the benefits of the invention accrue to other forms of fabric care apparatus, such as for example, clothes washers/dryers and washing/dry cleaning combination machines. Therefore, fabric care machine 100 is provided by way of illustration rather than limitation. Accordingly, the following description is for illustrative purposes only, and there is no intention to limit application of the invention to any fabric care machine, such as fabric care machine 100.

Figure 2:
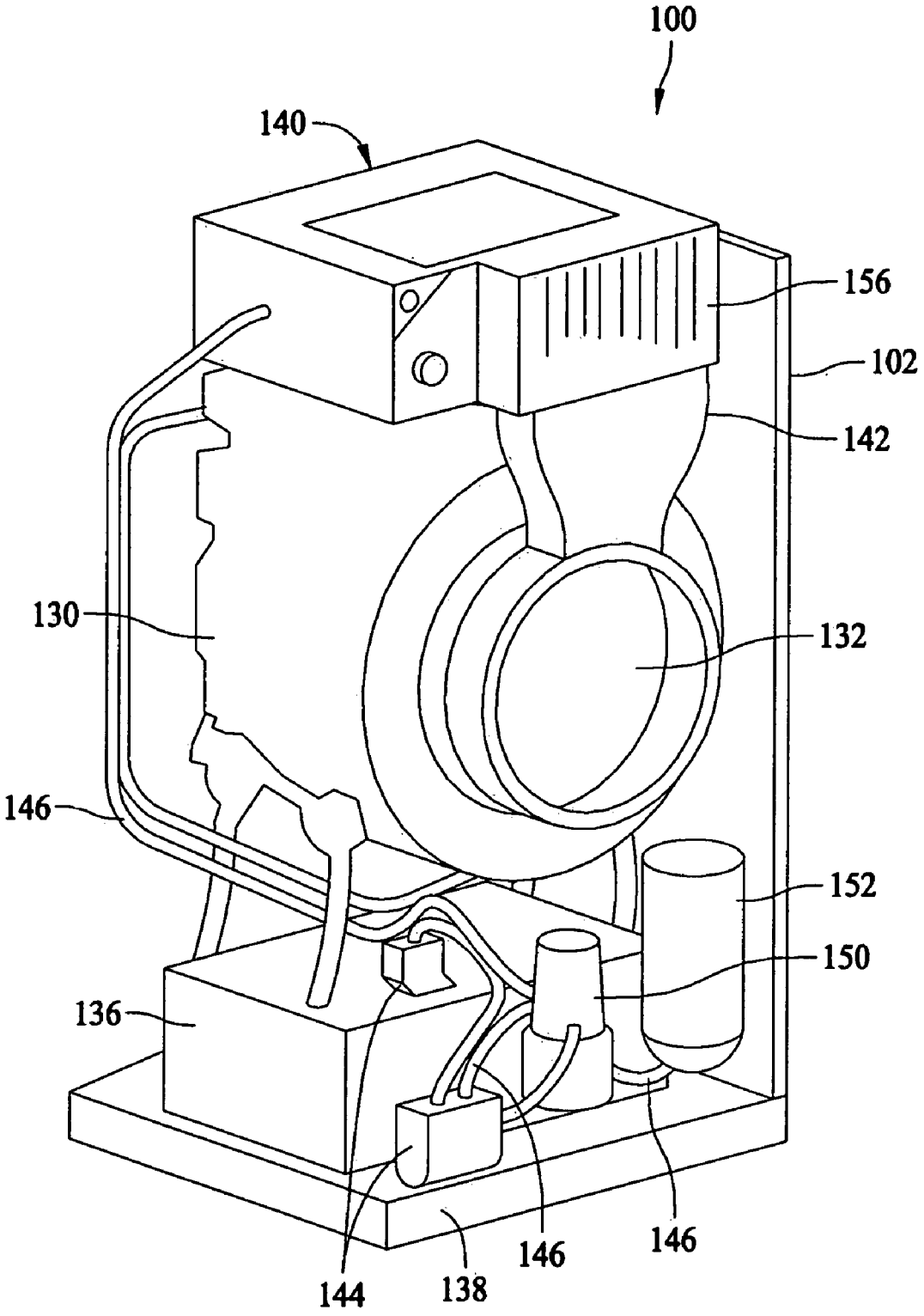
FIG. 2 is a perspective cutaway view of the fabric care machine shown in FIG. 1 with the cabinet partially removed.

FIG. 2 is a perspective cutaway view of machine 100 with cabinet 102 partially removed. Machine 100 includes a tub 130 that has an opening 132 which provides access to a clothes basket (not shown) that is rotatably mounted within tub 130. A storage tank 136 for cleaning fluid, such as dry cleaning fluid, is located on a cabinet base platform 138 beneath tub 130. Dry cleaning fluid, due to its cost is recycled after clothes are cleaned and stored in storage tank 136 for reuse. A fluid recovery system 140 is positioned above tub 130 to recover liquid and evaporated dry cleaning fluid as will be described. A return duct 142 returns filtered air from fluid recovery system 140 to tub 130. A plurality of pumps 144 are located beneath tub 130 to deliver dry cleaning fluid from storage tank 136 to various components of machine 100, including tub 130 and to return recovered fluid to storage tank 136. A plurality of fluid lines 146 extend between pumps 144, storage tank 136, tub 130, fluid recovery system 140, as well as a water separator 150 and a canister filter 152, and other components.

Water separator 150 removes water from the cleaning fluid. Water is not normally used in a dry cleaning process, however, water may be present in dry cleaning machine 100 from humidity in the air or a wet garment in the clothes load. Canister filter 152 is part of a multi-stage filtration process, the first stage of which occurs in fluid recovery system 140.

Operation of machine 100 is controlled by a main controller 156 which is operatively coupled to the user interface input located on front panel 104 (shown in FIG. 1) of machine 100 for user manipulation to select cycles and features. In response to user manipulation of the user interface input, main controller 156 operates the various components of machine 100 to execute selected machine cycles and features.

Figure 3:
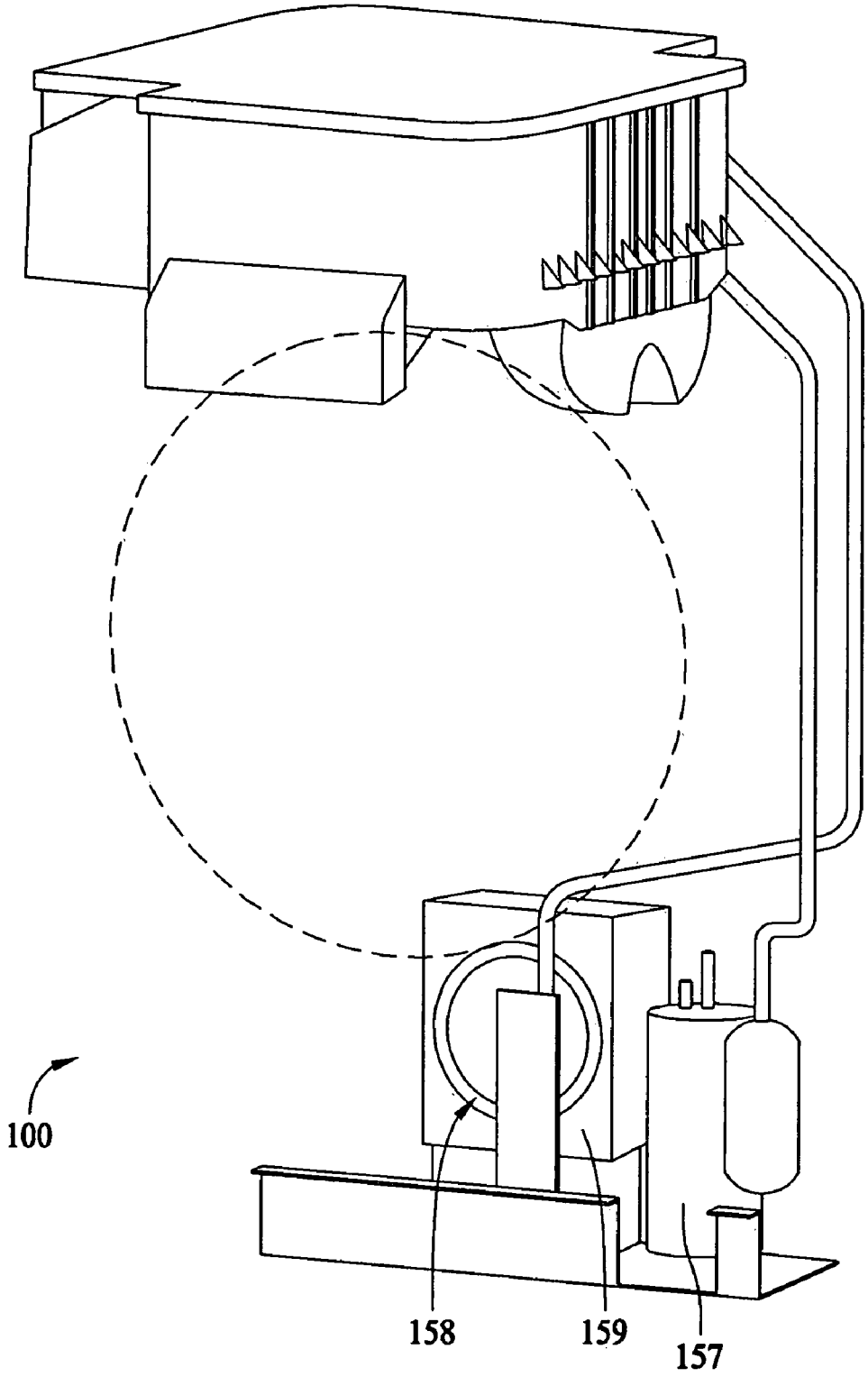
FIG. 3 is a perspective cutaway view of the fabric care machine from another angle.

FIG. 3 is a perspective cutaway view of machine 100 from another angle, and cabinet 102 and wash tub 130 (shown in FIG. 2) are omitted from FIG. 3 for clarity. Machine 100 also includes a compressor 157 and a heat exchange assembly 158 having a fan 159 located on cabinet base platform 138 (shown in FIG. 2). Heat exchange assembly 158 is utilized to control a temperature of refrigerant entering the dehumidification chamber condenser. Compressor 157 is operatively coupled to controller 156 (shown in FIG. 2), and may be energized in a drying cycle of dry cleaning machine 100 (described in detail hereinafter).

Figure 4:
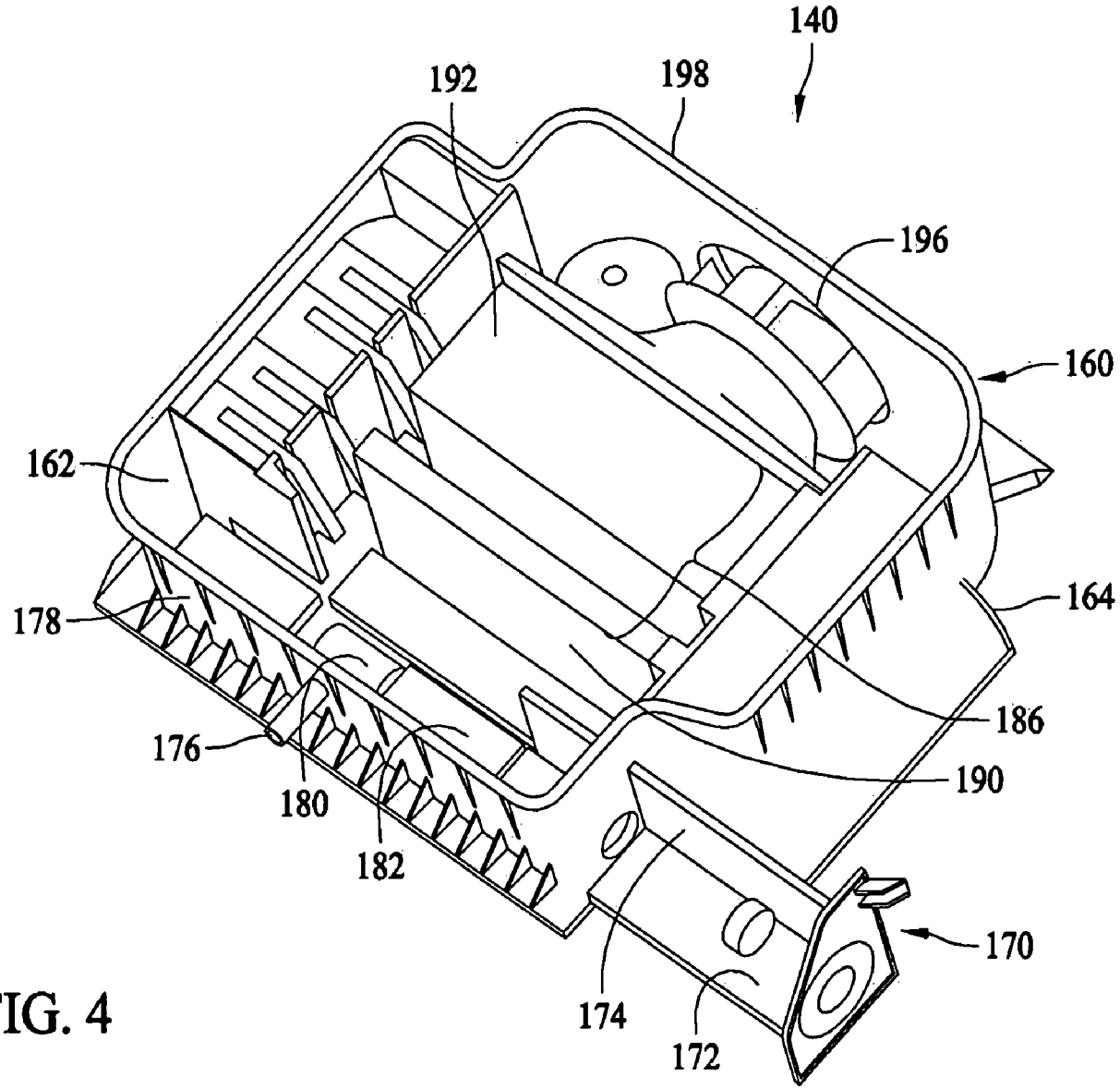
FIG. 4 is a perspective view of a cleaning fluid recovery system.

FIG. 4 is perspective view of cleaning fluid recovery system 140. Fluid recovery system 140 includes a housing 160 that defines an air inlet 162 and an air outlet 164. As used herein, air is generally intended to encompass any mixture of gases that may be found within a dry cleaning machine, including liquids in a vapor state, such as, but not limited to vaporized dry cleaning fluid and water vapor. A dual particulate filter assembly 170 is slidably received in housing 160. Air inlet 162 admits air into fluid recovery system 140 and directs the air toward filter assembly 170. As illustrated in FIG. 4, filter assembly 170 is partially removed from housing 160. Filter assembly 170 includes a wet or liquid filter element 172 and a dry or gas filter element 174 to filter air circulated over the clothes during the drying cycle. A fluid inlet line 176 extends through a side wall 178 of housing 160. A nozzle or baffle 180 is attached to an interior side of side wall 178 at the entry of fluid inlet line 176. Nozzle 180 directs incoming fluid downward onto wet filter element 172 of filter assembly 170. Air entering housing 160 through air inlet 162 is directed to flow along filter assembly 170 and through dry filter element 174. A sump 182 is formed in a bottom of housing 160 in an area located beneath filter assembly 170 when filter assembly 170 is installed in housing 160.

Fluid recovery system 140 further includes a dehumidifying assembly 186 for removing vaporized fluid from the air flow therethrough. Dehumidifying assembly 186 includes an evaporator 190 and a condenser 192. Evaporator 190 is in flow communication with filter assembly 170 and receives air exiting dry filter element 174. Condenser 192 is also in flow communication with filter assembly 170 and with evaporator 190 and receives air exiting evaporator 190. A fan 196 is positioned within housing 160 for creating an air flow through dehumidifying assembly 186. A gasket 198 is provided along an upper edge of housing 160 for sealing between housing 160 and top panel 106 (shown in FIG. 1) of cabinet 102 (shown in FIG. 1).

Figure 5:
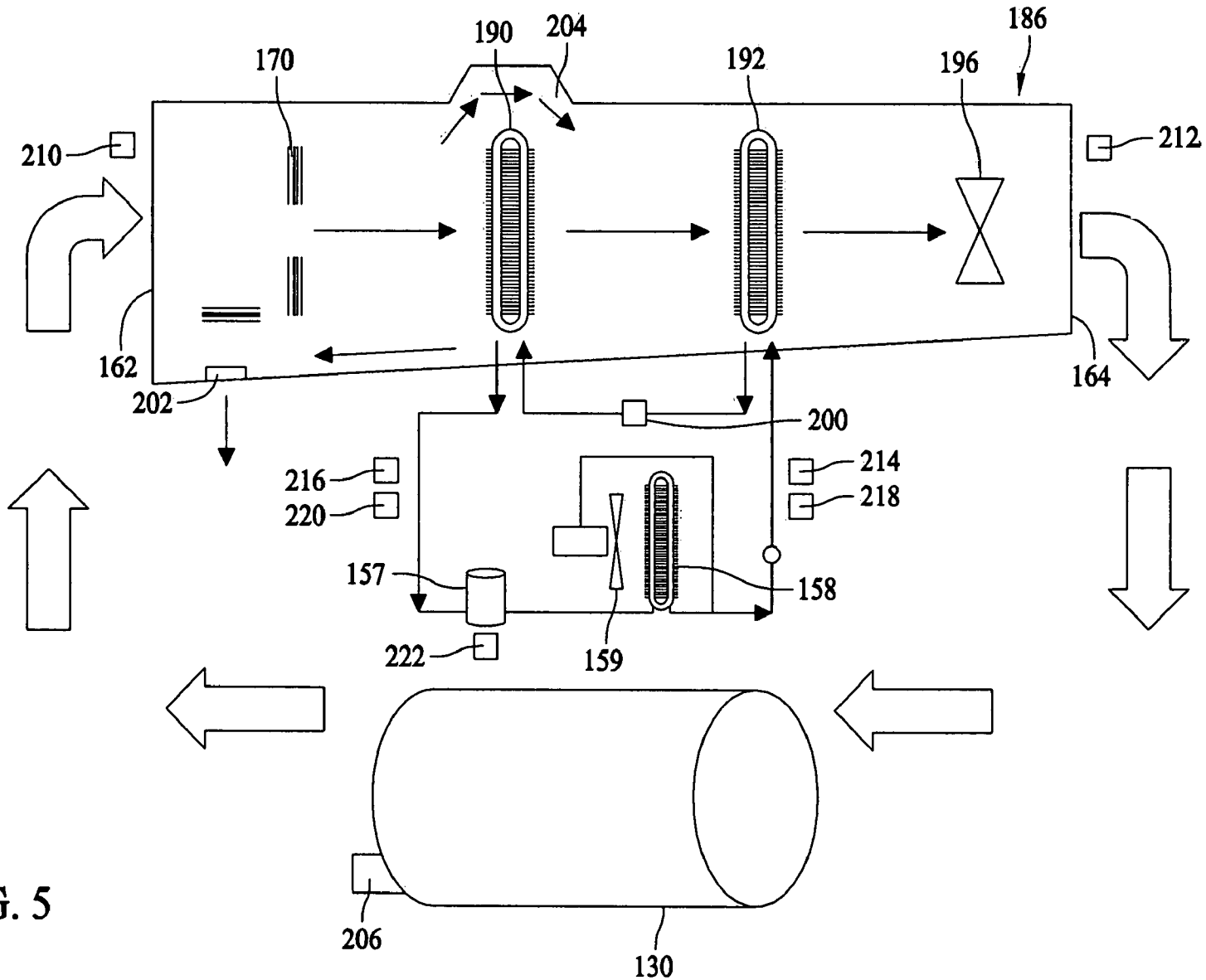
FIG. 5 is a schematic view of an exemplary air flow path of the fabric care machine shown in FIG. 1.

FIG. 5 is a schematic view of an exemplary air flow path in dry cleaning machine 100. In the exemplary embodiment, compressor 157, heater assembly 158, condenser 192, and evaporator 190 are coupled in flow communication with one another in series, and collectively form a cycle circuit which allows refrigerant to flow therethrough. The cycle circuit also includes an expansion device, such as for example, a capillary tube 200 positioned between and coupled in flow communication with condenser 192 and evaporator 190.

During the drying cycle which is generally at the end of the dry clearing process, compressor 157 is energized to compress the refrigerant flowing therethrough, such that the compressed refrigerant has a relatively higher temperature and a relatively higher pressure. The compressed refrigerant flows into condenser 192, and dissipates heat to the air flowing through condenser 192 for cooling the refrigerant. The refrigerant with a relatively higher pressure then flows through capillary tube 200 and becomes a refrigerant having a relatively lower pressure, and the refrigerant evaporates and absorbs heat from the air flowing through evaporator 190. In one embodiment, heater assembly 158 energizes fan 159 to transfer excess heat from the refrigerant to the exterior when the refrigerant leaving compressor 157 has an excessively high temperature. The detailed structure and operation of the refrigerant cycle circuit are believed to be within the purview of those in the art and generally beyond the scope of the present invention, so further discussion thereof is omitted.

During the drying cycle, fan 196 is energized to draw air from wash tub 130 into dehumidifying assembly 186 through air inlet 162, and channel the air from dehumidifying assembly 186 back to wash tub 130 through air outlet 164. Specifically, fan 196 establishes an air flow path from wash tub 130, through dry filter element 174, evaporator 190, and condenser 192, and back to wash tub 130. More specifically, air is heated by the compressed refrigerant when flowing through condenser 192, and the heated air is channeled into wash tub 130 through air outlet 164. The heated air flows through the wet clothes contained in wash tub 130, and removes moisture from the wet clothes. The heated air then becomes humid air and is drawn into air inlet 162 by fan 196. The humid air flows through evaporator 190, and water condensation occurs when the humid air contacts the inner surface of evaporator 190 which has a relatively lower temperature. The dehumidified air is then drawn into and heated by condenser 192, and is channeled back into wash tub 130 for drying the wet clothes. As such, air is continuously cycled through the flow path to remove moisture from the wet laundry and condense the moisture in evaporator 190. The drying cycle is stopped when the detected dryness of the clothes reaches a predetermined level (described in detail hereinafter).

In an exemplary embodiment, the condensed water of dehumidifying assembly 186 is collected and channeled to a drain (not shown) outside through a water outlet 202 of dehumidifying assembly 186. In another embodiment, dehumidifying assembly 186 includes a bypass passage 204 for bypassing evaporator 190 from the air flow path upon a predetermined occurrence, such as for example, the dryness of the clothes reaches a predetermined level. In still another embodiment, wash tub 130 includes an air outlet 206 for channeling the air to the exterior of machine 100 at the end of the drying cycle.

Machine 100 also includes a detecting component positioned therein and operatively coupled to controller 156. The detecting component detects an operational status of dehumidifying assembly 186, and controller 156 calculates a dryness level of the clothes contained in wash tub 130 based on the signal received from the detecting component. Specifically, the detecting component detects at least one of a temperature value, a pressure value, and/or a wattage value from dehumidifying assembly 186 for determining the dryness of the clothes.

In one exemplary embodiment, the detecting component includes a first detecting component for detecting a first operational value from a first portion of dehumidifying assembly 186, and a second detecting component for detecting a second operational value from a second portion of dehumidifying assembly 186 which is different than the first portion.

Specifically, the detecting component includes a first temperature sensor 210 for detecting a temperature of the air entering dehumidifying assembly 186, and a second temperature sensor 212 for detecting a temperature of the air exiting dehumidifying assembly 186. First temperature sensor 210 is positioned upstream of air inlet 162 in the flow path, and second temperature sensor 212 is positioned downstream of air outlet 164 in the flow path. It is contemplated that first temperature sensor 210 is positioned between air inlet 162 and evaporator 190 in the flow path, and second temperature sensor 212 is also positioned between air outlet 164 and condenser 192 in the flow path in alternative embodiments.

In an alternative embodiment, the detecting component includes a first temperature sensor 214 for detecting a temperature or the refrigerant entering condenser, and a second temperature sensor 216 for detecting a temperature of the refrigerant exiting evaporator 190. In another embodiment, the detecting component includes a first pressure transducer 218 for detecting a pressure of the refrigerant entering condenser 192, and a second pressure transducer 220 for detecting a pressure of the refrigerant exiting evaporator 190. In still another embodiment, the detecting component includes a wattage metering component 222 for detecting the power consumption, i.e., wattage, of compressor 157.

Evaporation of the liquid contained in the wet clothes absorbs heat from the air channeling through wash tub 130. The amount of such liquid evaporation in wash tub 130 then affects a temperature change of the air channeling through wash tub 130, a temperature change and/or a pressure change of the refrigerant channeling through condenser 192 and evaporator 190, and the wattage of compressor 157. A correlation is then established between the dryness level of the clothes and the temperature/pressure change, or the wattage. Thus, controller 156 is able to calculate a difference between the air temperatures detected by temperature sensors 210, 212, between the refrigerant temperatures detected by temperature sensors 214, 216, and/or between refrigerant pressures detected by pressure transducers 218, 220. Controller 156 determines a dryness level of the clothes based on the calculated difference. In an alternative embodiment, controller 156 detects a dryness level of the clothes based on the wattage of compressor 157 detected by wattage metering component 222.

Upon determining a dryness level of the clothes, controller 156 determines when to stop the drying cycle. Specifically, controller 156 de-energizes fan 196 and compressor 157 to stop the air flow when the determined dryness level reaches a predetermined level. Alternatively, controller 156 de-energizes fan 196 and compressor 157 after a predetermined time period initiated from when the calculated dryness level reaches the predetermined level for ensuring the clothes reach a desired dryness level. In one embodiment, the predetermined dryness level is preset and stored in machine 100. In addition, the predetermined dryness level is also inputted or altered by the operator through the user interface shown in FIG. 1).

Controller 156 determines a dryness level of the clothes contained in wash tub 130, which facilitates obtaining a desired dryness level without regard for type of chemical used to wash or rinse the clothes. In addition, controller 156 facilitates relatively precise control of the dryness of the clothes with little operator manipulation involved.

While the invention has been described in terms of various specific embodiments, those skilled in the art will recognize that the invention can be practiced with modification within the spirit and scope of the claims.

What is claimed is:

1. A fabric care apparatus comprising:

a cabinet;

a wash tub mounted within said cabinet and configured to receive clothes therein;

a dehumidifying assembly mounted within said cabinet and configured to remove vaporized fluid from the airflow therethrough;

a fan configured to draw air from said wash tub to said dehumidifying assembly and channel the air from said dehumidifying assembly back to said wash tub;

a dual particulate filter assembly positioned within said cabinet, said dual particulate filter assembly comprising a filter frame, a first filter element mounted within said filter frame, said first filter element configured to filter the airflow through said dehumidifying assembly, and a second filter element mounted within said filter frame, said second filter element configured to filter a liquid entering said dual particulate filter assembly;

at least one detecting component configured to detect an operational status of said dehumidifying assembly, said at least one detecting component comprising at least one of a temperature sensor, a pressure transducer, and a wattage metering component; and a controller operatively coupled to said detecting component, said controller configured to receive a signal from said detecting component and determine a dryness level of the clothes received in said wash tub based on the received signal.

2. An apparatus in accordance with claim 1 wherein said dehumidifying assembly comprises a compressor, a condenser, and an evaporator which form a cycle circuit, said dehumidifying assembly configured to channel refrigerant through said circuit.

3. An apparatus in accordance with claim 2 wherein said at least one detecting component comprises a first detecting component configured to detect a first operational value from a first portion of said dehumidifying assembly, and a second detecting component configured to detect a second operational value from a second portion of said dehumidifying assembly which is different than the first portion.

4. An apparatus in accordance with claim 3 wherein said controller configured to determine the dryness level based on a difference between the detected operational values.

5. An apparatus in accordance with claim 3 wherein said first detecting component configured to detect a temperature of the refrigerant entering said condenser, and said second detecting component configured to detect a temperature of the refrigerant exiting said evaporator.

6. An apparatus in accordance with claim 3 wherein said first detecting component configured to detect a pressure of the refrigerant entering said condenser, said second detecting component configured to detect a pressure of the refrigerant exiting said evaporator.

7. An apparatus in accordance with claim 3 wherein said first detecting component configured to detect a temperature of the air entering said dehumidifying assembly, said second detecting component configured to detect a temperature of the air exiting said dehumidifying assembly.

8. An apparatus in accordance with claim 1 wherein said detecting component configured to detect a wattage of said compressor.

9. An apparatus in accordance with claim 1 wherein said controller configured to de-energize said compressor when the calculated dryness level reaches a predetermined level.

10. A method for assembling a clothes treating apparatus comprising:

providing a cabinet;

mounting a wash tub within the cabinet, the wash tub configured to receive clothes therein;

mounting a dehumidifying assembly within the cabinet, the dehumidifying assembly configured to remove vaporized fluid from the airflow therethrough;

providing a fan configured to draw air from the wash tub to the dehumidifying assembly and channel the air from the dehumidifying assembly back to the wash tub;

removably positioning a dual particulate filter assembly within the cabinet, the dual particulate filter assembly including a filter frame, a first filter element mounted within the filter frame, the first filter element configured to filter the airflow through the dehumidifying assembly, and a second filter element mounted within the filter frame, the second filter element configured to filter a liquid entering the dual particulate filter assembly;

providing at least one detecting component configured to detect an operational status of the dehumidifying assembly, the at least one detecting component comprising at least one of a temperature sensor, a pressure transducer, and a wattage metering component; and operatively coupling a controller with the detecting component, the controller configured to receive a signal from the detecting component and determine a dryness level of the clothes contained in the wash tub based on the received signal.

11. A method in accordance with claim 10 wherein said mounting a dehumidifying assembly comprises mounting a dehumidifying assembly including a compressor, a condenser, and an evaporator which form a cycle circuit, the dehumidifying assembly configured to channel refrigerant through the circuit.

12. A method in accordance with claim 11 wherein said providing at least one detecting component comprises providing a first detecting component configured to detect a first operational value from a first portion of the dehumidifying assembly, and providing a second detecting component configured to detect a second operational value from a second portion of the dehumidifying assembly which is different than the first portion.

13. A method in accordance with claim 12 wherein said coupling a controller comprises coupling a controller configured to determine the dryness level based on the difference between the detected operational values.

14. A method in accordance with claim 12 wherein said providing a first detecting component comprises providing a first detecting component configured to detect a temperature of the air entering the dehumidifying assembly, and said providing a second detecting component comprises providing a second detecting component configured to detect a temperature of the air exiting the dehumidifying assembly.

15. A method in accordance with claim 12 wherein said providing a first detecting component comprises providing a first detecting component configured to detect a temperature of the refrigerant entering the condenser, and said providing a second detecting component comprises providing a second detecting component configured to detect a temperature of the refrigerant exiting the evaporator.

16. A method in accordance with claim 10 wherein said coupling a controller comprises coupling a controller configured to de-energize the compressor based on when the determined dryness level reaches a predetermined level.

* * * * *